US010788183B2

(12) United States Patent
Mertens et al.

(10) Patent No.: US 10,788,183 B2
(45) Date of Patent: Sep. 29, 2020

(54) LIGHTING ARRANGEMENT WITH AN EXCHANGEABLE LIGHTING CAP

(71) Applicant: Lumileds LLC, San Jose, CA (US)

(72) Inventors: Jürgen Mertens, Wuerselen (DE); Cornelis Versluijs, Eindhoven (NL)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/348,767

(22) PCT Filed: Nov. 3, 2017

(86) PCT No.: PCT/EP2017/078137

§ 371 (c)(1),
(2) Date: May 9, 2019

(87) PCT Pub. No.: WO2018/086994

PCT Pub. Date: May 17, 2018

(65) Prior Publication Data

US 2019/0293254 A1 Sep. 26, 2019

(30) Foreign Application Priority Data

Nov. 9, 2016 (EP) ..... 16197903

(51) Int. Cl.

| | |
|---|---|
| ***F21S 41/19*** | (2018.01) |
| ***F21S 45/50*** | (2018.01) |
| ***F21S 41/143*** | (2018.01) |
| ***F21V 29/74*** | (2015.01) |
| ***F21V 17/14*** | (2006.01) |

(Continued)

(52) U.S. Cl.

CPC ..... *F21S 41/194* (2018.01); *F21S 41/143* (2018.01); *F21S 45/50* (2018.01); *F21V 17/14* (2013.01); *F21V 29/74* (2015.01); *F21Y 2103/00* (2013.01); *F21Y 2115/10* (2016.08)

(58) Field of Classification Search

CPC ..... F21S 41/194; F21S 41/143; F21S 45/50; F21V 29/74; F21V 17/14; F21Y 2115/10; F21Y 2103/00

See application file for complete search history.

(56) References Cited

U.S. PATENT DOCUMENTS 7,988,336 B1 * 8/2011 Harbers ..... F21K 9/00 362/294

FOREIGN PATENT DOCUMENTS

| | | | |
|---|---|---|---|
| CN | 204853041 | U | 12/2015 |
| CN | 204879659 | U | 12/2015 |
| JP | 2008277230 | A | 11/2008 |

* cited by examiner

*Primary Examiner* — Mary Ellen Bowman
(74) *Attorney, Agent, or Firm* — Volpe and Koenig, P.C.

(57) ABSTRACT

A lighting arrangement with an exchangeable lighting cap, includes a holder for the lighting cap and a lock lever to lock the lighting cap in position on the holder. The front face of the lighting caps has at least one light emitting element, for emitting light in a direction perpendicular to the front face. The edge of the front face has two positioning slots that are perpendicular to the direction of illumination. The holder comprises an opening for receiving the front face and has two positioning elements arranged at a rim of the opening, wherein the positioning elements can be inserted into the positioning slots of the lighting cap by elastic deformation to fix the position of the lighting cap on the holder. The lock lever has an open position for inserting the lighting cap into the holder and a locked position for locking the lighting cap in position.

13 Claims, 5 Drawing Sheets

(51) Int. Cl.
*F21Y 115/10* (2016.01)
*F21Y 103/00* (2016.01)

LIGHTING ARRANGEMENT WITH AN EXCHANGEABLE LIGHTING CAP

FIELD OF THE INVENTION

The invention relates to a lighting arrangement. In particular, the invention relates to a lighting arrangement with an exchangeable, precisely positioned lighting cap.

BACKGROUND OF THE INVENTION

In particular, in automotive lighting, exchangeable lighting caps are used as light emission elements in a number of different lighting applications such as front lighting, fog lighting, daytime running lighting, reverse lighting or signalling.

For lighting applications in general and in particular for automotive front lighting, the illumination beam emitted from the lighting arrangement must follow tight specifications. This requires exact positioning of the elements of the lighting arrangement relative to each other and in particular of the exchangeable lighting cap in the lighting arrangement, especially when the light emission element comprises an LED as the light source.

In automotive lighting, for the positioning of light emission elements in lighting arrangements different lighting caps in combination with a specifically designed holder are used. Those fit systems are based on narrow tolerated fits, as for example in a combination of an H10 or an H12 lamp with a PY20d or PZ20d socket, respectively. However, there is always a positive play between the lamp and the socket in those fit systems and therefore, the position of the lamp as the light emission element is not well defined.

Alternatively, those fit systems are based on a spring-loaded system to hold the lighting cap in position in a holder, as for example used for an H7 lamp in combination with a PX26d holder. However, those lamps are hard to exchange, expensive to produce and additionally, the force of the spring might lead to an unintended, tilted position of the lamp in the holder.

Additionally, those fit systems often use a large axial mating reference plane adjacent to the light source of the lighting cap for alignment with the holder, causing large interruptions for the optical definition and cut-out zones in the light beam pattern of the lighting arrangement.

Reference U.S. Pat. No. 7,988,336 B 1 shows an apparatus with an LED based illumination module comprising a first thermal interface surface and a plurality of elastic mounting members, a mounting collar fixedly coupled to a light fixture comprising a plurality of module engaging members, and a second thermal interface surface, wherein the illumination module and the mounting collar are moveable with respect to each other from a disengaged position to an engaged position, wherein a movement to the engaged position deforms the plurality of elastic mounting members and generates a compressive force between the first thermal interface surface and the second thermal interface surface.

SUMMARY OF THE INVENTION

It may be considered an object to propose a lighting arrangement which facilitates exact positioning of an exchangeable lighting cap relative to a holder.

It may also be considered an object to provide a lighting arrangement with a lighting cap which can easily be exchanged and locked into position.

Further, it would be advantageous to reduce the production costs of a lighting arrangement.

Finally, it may be considered an object to provide a lighting arrangement that avoids large interruptions of the optical definition and in particular large cut-out zones of the emitted light beam pattern.

To better address one or more of these concerns, in one aspect of the invention a lighting arrangement according to claim 1 and a lighting cap according to claim 13 are presented. Additionally, in another aspect of the invention a method for turn-locking a lighting cap in a lighting arrangement is proposed according to claim 14. Dependent claims refer to preferred embodiments of the invention.

The present inventors have recognized that in the presently used fit systems of lighting arrangements there is always a certain positive play between the components. However, the inventors have found that by using the elastic properties of the materials of at least one component of the lighting arrangement, a tight fitting is possible by allowing a negative play between the components in combination with an elastic deformation of at least one of the components provided by the elasticity of the used material.

According to one aspect of the invention, the lighting arrangement comprises an exchangeable lighting cap, a holder for the lighting cap and a lock lever to lock the lighting cap in position on the holder. At least one light emitting element is arranged on a front face of the lighting cap, emitting light at least in a direction of illumination perpendicular to the front face. Additionally, at the edge of the front face of the lighting cap two positioning slots are arranged in an alignment perpendicular to the direction of illumination. The holder comprises an opening for receiving the front face of the lighting cap and two positioning elements are arranged at a rim of the opening, wherein the positioning elements can be inserted into the positioning slots of the lighting cap by elastic deformation to fix the position of the lighting cap on the holder. Finally, a lock lever is arranged at the lighting cap and the holder, wherein the lock lever can be turned between an open position for inserting the lighting cap into the opening of the holder and a locked position for locking the lighting cap in position on the holder.

This setup advantageously allows to arrange a lighting cap precisely positioned in the holder repeatedly and to minimize the positive play between both components leading to an unwanted change in the beam pattern of the lighting arrangement. Additionally, the lighting cap can be easily exchanged und locked in position with the lock lever. Finally, the production costs of the lighting arrangement are favourably low, since no elaborate spring mechanism is necessary to lock the lighting cap in position.

According to another aspect of the invention, a method for turn-locking a lighting cap in a lighting arrangement comprises the steps of first providing a holder with an opening for the lighting cap with two positioning elements arranged at a rim of the opening, followed by turning a lock lever with an opening into an open position, wherein the opening of the lock lever and an opening of the holder are aligned. Afterwards, the lighting cap is inserted into the openings of the lock lever and the holder and the lock lever is turned into a locked position locking the lighting cap to the holder.

The lighting arrangement according to the invention can in general be used in any lighting application. In particular, the lighting arrangement may be used for a number of different automotive lighting applications such as front lighting, fog lighting, daytime running lighting, reverse lighting or signalling. In particular, the use in auto-motive forward-lighting may be preferred.

The lighting arrangement according to the invention comprises an exchangeable lighting cap with at least one light emitting element and two positioning slots. Generally, the lighting cap may be any exchangeable illumination element, for example a lamp or a luminaire. The lighting cap may comprise further components, such as electrical connectors, in particular on a side of the lighting cap opposing the light emitting element, or a cooling body, preferably comprising parts made of thermally conductive plastic. It is particularly preferred that at least an area or a portion of the lighting cap adjacent to the positioning slots is made out of an elastic material, in particular preferred an elastic polymer. Additionally, at least a portion of the lighting cap adjacent to the light emitting element may preferably be made of a thermally conductive polymer material. Most preferably, an entire body of the lighting cap is made out of at least one elastic and thermally conductive polymer material. It is also preferred that the lighting cap is a one-piece component, in particular without any removable parts.

The at least one light emitting element of the lighting cap may be any device able to emit light, such as an incandescent light bulb, in particular a halogen lamp, an LED lamp, an arc lamp or a gas-discharge lamp. Preferably, the light emitting element is any type of single solid state lighting element, such as light emitting diodes (LED), laser diodes, organic light emitting diodes (OLED) and the like, or a group of several identical or different solid state lighting elements. A particularly preferred light emitting element may be an LED, more preferably a surface-mounted LED, wherein the LED most preferably may have a plane light emitting surface. The light emitting surface may preferably be of rectangular shape.

The light emitting element is arranged on a front face of said lighting cap, wherein the direction of illumination is perpendicular to the front face. Preferably, the light emitting element may be placed in the center of the front face. The front face may be a flat surface of the lighting cap surrounding the light emitting element and/or the front face may be an area of the lighting cap, which is visible in a lighting cap arranged in a holder from the direction of illumination. The light emitting element may be arranged on or within the front face. When being arranged on the surface of the front face, the light emitting element may preferably be enclosed by a frame on the surface of the front face, wherein the frame may be most preferably as high as the light emitting element. As the direction of illumination a direction may be understood, where most light from the light emitting element is directed and/or which is orthogonal to a flat surface area of the light emitting element.

At the edge of the front face, two positioning slots are arranged, which are aligned perpendicular to the direction of illumination. Each slot has at least an open section in the direction of illumination and has a well-defined length in a direction perpendicular to the direction of illumination. Generally, each of the positioning slots may have any shape and/or both positioning slots may have different shapes and/or sizes. Preferably, both positioning slots may have the same size and/or shape. Also preferably, the side wall facing the inside of the slot or the three inner faces of the slot, if the slot has a rectangular shape, may have a surface normal which is perpendicular to the direction of illumination and/or may be in the plane of the front face or in a plane parallel to the front face. Also preferably, each of the slots may be directed towards the light emitting element. The positioning slots may be arranged partly or fully in the front face approximating to an edge thereof or the positioning slots may be partly or fully arranged at another component of the lighting cap, which is arranged adjacent to the front face. The positioning slots and in particular an open side of each positioning slot may be arranged in the same plane as the front face or may be arranged in a plane shifted backwards relative to the front face, in particular in the direction of illumination and/or in the direction of insertion of the lighting cap into the holder. Most preferably, both positioning slots are arranged in one plane, which is identical or parallel to the front face of the lighting cap. It is also particularly preferred that at least the area or portion around the positioning slots may be made of an elastic material and even more preferably of an elastic polymer material. To provide a particularly precise positioning of a lighting cap, only one of the three inner faces of each positioning slot may be made out of an elastic material to deform during insertion of a lighting cap and the other two inner faces may be inelastic, wherein it may be especially preferred to use also an inelastic material for the positioning elements of the lighting cap. However, the positioning elements may also be made out of an elastic material.

Generally, the holder is a component of the lighting arrangement, which receives the lighting cap and is able to fix the position of the lighting cap in at least one, preferably in at least two spatial directions. The holder may be a discrete component of the lighting arrangement, which is fixed to another component of the lighting arrangement, or the holder may be part of a component with at least one additional function to holding the lighting cap. In particular, the holder may be attached to or part of an element that may shape or alter the emitted light beam, such as in particular a collimator, a reflector, a lens, a luminaire or the like.

According to one aspect of the invention, the holder comprises an opening for receiving a part of the lighting cap, in particular a part comprising the front face. Additionally, also further parts of the lighting cap may be positioned in or guided through the opening. Preferably, the shape of the opening of the holder may be adapted to the shape of the lighting cap in the area of the front face and in particular also to components arranged at the lighting cap in plane with or adjacent to the front face, for example both wings.

At the rim of the opening of the holder, two positioning elements are arranged. As the rim of the opening, the surface area of the holder is understood, which forms the edge of the opening of the holder and/or which has an orientation perpendicular to the direction of illumination. The positioning elements may have any shape and/or size. Preferably, the positioning elements are dimensioned and/or shaped to be able to be inserted into the slots under elastic deformation, in particular to allow for a press-fitting of both parts. In general, elastic deformation is a reversible deformation of the material, wherein the material deforms due to a force and once the force is no longer applied, the material returns to its original shape. Most preferably the size of a positioning element may be at least in one, preferably in two spatial directions by between 0.1 and 10%, more preferably between 0.5 and 5% and most preferably between 1 and 3% larger than the corresponding size of the positioning slots of the lighting cap, leading to a deformation of the positioning element and/or of the positioning slot during the insertion of the positioning element into the positioning slot. The compression of the positioning elements in the positioning slots and/or the stretching or expansion of the positioning slots under the force of the insertion of the positioning elements allows a play-free fit of both elements and accordingly a very precise placing of the lighting cap in the holder. It is particularly preferred that at least the positioning elements may be made of an elastic material and most preferably of an elastic polymer material. Both positioning elements may be shaped differently and/or have a different size, however, preferably, both positioning elements have an identical shape and/or size to one another.

The lock lever is arranged at the lighting cap and at the holder and can be turned between an open position, where the opening of the holder is not covered by any part of the lock lever and a lighting cap can be inserted into the opening, and a locked position, where the lighting cap inside the opening of the holder cannot be removed from the holder and/or where the position of the lighting cap is fixed to the holder. Generally, the lock lever may have any shape. Preferably, at least a section of the lock lever is a ring, which is more preferably surrounding a section of the lighting cap, in particular a section recessed relative to the front face in the direction of illumination. The lock lever is preferably positioned on the side of the holder, from which the lighting cap can be inserted into the opening of the holder. It is preferred that the lock lever is turntable between the open position and the locked position in a plane parallel to the reference plane and/or the support plane surface and/or to the front face of the lighting cap. In particular preferred, the lock lever may be rotatable between the open position and the locked position by an angle between 5° and 180°, preferably between 15° and 90°, more preferably between 25° and 65° and most preferably between 40° and 50°.

In the locked position, the lock lever may also be fixed relative to the holder at least in the direction of illumination. Preferably, the lock lever moves into at least one, more preferably at least two engaging elements of the holder when being turned from the open into the locked position, wherein the engaging elements most preferably secure the lock lever against further turning into the direction of the locked position and/or against movement of the lock lever against the direction of illumination.

Preferably, the lighting cap may be first inserted into the opening of the lock lever and afterwards into the opening of the holder, wherein the lock lever is arranged between the holder and the lighting cap, in particular the support plane surface of the lighting cap. Also preferably, the lock lever may be brought first in an in-plane contact with a surface of the holder and afterwards the lighting cap may be inserted from the side of the lock lever into the openings of the lock lever and the holder.

In a preferred embodiment, the lock lever has an opening for at least the front face of the lighting cap, where the front face of the lighting cap is first guided through the opening of the lock lever and afterwards placed in the opening of the holder. Most preferably, the opening of the lock lever and the opening of the holder are identically shaped and/or are fully aligned in the open position of the lock lever. In a preferred embodiment, the lock lever has two handles for turning the lock lever by hand, preferably on two opposing sides of the lock lever, in particular relative to the opening of the lock lever.

According to a preferred embodiment of the invention, the positioning elements are rounded pins and the positioning slots have a rectangular shape with three inner faces, wherein the rounded pins in an inserted position inside the positioning slots are elastically deformed, in particular compressed. Additionally, each of the rounded pins is in contact with each of the three inner faces of one positioning slot, which leads to an advantageously precise positioning of the lighting cap relative to the holder and at the same time allows an easy insertion of the pins into the positioning slots, since the material of the pins can be pressed partially into the edges of the rectangular slots during compression. The pins may be rounded in two or three spatial directions, preferably the pins are rounded only in the two spatial directions perpendicular to the direction of illumination and flat in the direction of illumination, leading at least to a contact area between the rounded pin and each of the three inner faces of the slot in the shape of a line. The pins may be rounded along their entire length or may have only a rounded head connected via a connecting section to the rim of the opening of the holder, wherein preferably the rounded head has a larger diameter than the connection section and accordingly, especially preferred only the rounded head is in contact with the three inner faces of the positioning slots.

Preferably, the positioning slots are arranged on opposing sides relative to the light emitting element, allowing to secure the lighting cap particularly well against a rotational offset. It is particularly preferred that both positioning slots are arranged symmetrically to each other on opposing sides of the center of the light emitting element and/or of the center of the front face of the lighting cap.

Further, it is preferred that the lighting cap comprises a first and a second wing at the edge of the front face, wherein each of the wings is aligned perpendicular to the direction of illumination and each of the positioning slots is positioned on one of the wings. The placement of each of the positioning slots on a wing allows advantageously an easy and cheap production of the lighting cap. As a wing any object is understood, which is arranged adjacent to the front face of the lighting cap. Preferably, both wings are not directly connected to each other. Also preferably, each of the wings extends only along a section of the circumference of the front face, in particular less than 160°, more preferably less than 135° and most preferably less than 90°. It is further preferred that the positioning slots permeate the full height of the wings in the direction of illumination.

While both wings may have the same width along the circumference of the front face, it is preferred that one wing has a different width along the circumference of the front face than the other wing. Alternatively or additionally, both wings may have a different height in the direction of insertion of the lighting cap into the holder and/or both wings may have a different length in a direction perpendicular to the direction of insertion. The direction of insertion may correspond to the direction of illumination, however depending on the arrangement of the light emitting element, both directions might also differ from one another. Most preferably, both wings have the same length as well as an identical height along the direction of illumination, but a different width along the circumference of the front face. The different shaping of both wings allows advantageously to introduce a key-lock-system to exclude different lighting cap categories on a specific holder, in particular for different thermal grading. A higher graded lighting cap may fit in a lower graded holder, but a lower graded lighting cap is blocked for insertion into a higher graded holder. The lower the grading of the cap is, preferably the longer the width of said wings of said lighting cap may be.

Preferably, both wings are arranged on the lighting cap in one plane parallel to the front face to allow an easy insertion of the lighting cap into the opening of the holder without an undesired tilting. The wings may also be arranged in a plane identical to the front face, however a slightly recessed placement of the plane of the wings, in particular by 0.1-5 mm, more preferably by 0.2-3 mm and most preferably by 0.25-2 mm may be advantageous to avoid any negative influence of the wings on the illumination pattern of the lighting arrangement.

In preferred embodiments of the invention, the shape of the opening of the holder receiving the wings, in particular of the complete opening, corresponds to the shape of both wings and in particular also to the front face of the lighting cap introducing a key-lock-system to exclude different lighting cap categories on a specific holder. However, there might be a certain tolerance, for example of up to 5%, preferably up to 2% and most preferably up to 1%. Accordingly, this embodiment advantageously allows tolerances in the dimensions of both the lighting cap and the holder resulting in a certain tolerance between both parts without having any influence on the alignment of the lighting cap in the holder, which is based on the positioning elements and the positioning slots. The front face and/or the wings or parts thereof may be in contact with an inner peripheral surface of the opening of the holder. However, the lighting cap may also be only in contact with the holder with the three inner faces of the positioning slots. Most preferably, the alignment of the lighting cap in the holder, at least in two spatial directions and preferably also in the direction of rotation around an axis in the direction of illumination, is based on the contact of the positioning elements and the positioning slots, wherein the other parts of the lighting cap, in particular the wings and/or the front face, might be contact-free from parts of the holder.

In another preferred embodiment, at least three faces of the lighting cap, in particular of an edge of the front face and/or of an edge of the wings, are in contact with an inner peripheral surface of the opening of the holder, wherein most preferably all three faces have different spatial orientations leading advantageously to a positioning of the lighting cap which is secured against transitional or rotational movements in any direction perpendicular to the direction of illumination.

According to one especially preferred embodiment, the lock lever has two surfaces, which are preferably parallel, wherein the second surface of the lock lever is in an in-plane support with the holder establishing a reference plane between the lock lever and the holder, in particular such that the lighting cap is in parallel alignment to the holder. It is particularly preferred that there is a contact between a surface of each of the holder, the lighting cap and the lock lever in the reference plane, leading to an in-line arrangement of the different components. In general, the reference plane ensures a precise positioning of the lighting cap relative to the holder and/or the lock lever, in particular in the direction of insertion of the lighting cap into the holder as well as regarding rotations around both axes perpendicular to the direction of insertion. Accordingly, in combination with the contact of the positioning elements in the positioning slots, the lighting cap is aligned and fixed in all three rotational as well as all three translational degrees of freedom. The inventors have considered that in lighting arrangements, especially in automotive lighting arrangements and in particular in LED forward lighting arrangements, optical elements or surfaces to reflect the light from a small planar light emitting area into the forward-lighting beam should be positioned as close as possible to the light emitting area of the light source and therefore an axial mating reference plane should not be positioned directly adjacent to the light emitting surface. Accordingly, the inventors have found that one solution might be to shifted the axial mating reference plane backwards and transferred the alignment of the lighting cap and the holder via the lock lever, allowing to place an optical element or surface very close to the light emitting element.

It is preferred that the lock lever is provided for bayonet locking the lighting cap to said holder, providing an easy way to lock both components during the exchange of a lighting cap by turn-locking. Additionally or alternatively, the holder might provide a spring function to press the lock lever against a surface of the holder, in particular in the direction of illumination. Preferably, the spring function may be achieved by arranging two spring holder on a surface of the holder to engage with the first surface of the lock lever in the locked position pressing the lock lever towards and/or onto the surface of the holder to ensure that the lock lever is arranged in the reference plane of the lock lever and the holder and preferably also the lighting cap. The spring holder might have any shape and size. Preferably, the two spring holder may be arranged adjacent to one another relative to the opening of the holder. Also preferably, each of the spring holder may be an elastic hook arranged on a surface of the holder facing the lock lever and/or may be encompassing an outer edge of the lock lever.

It is further preferred that the second surface of the lock lever is partially in an in-plane support with a contact surface of each of the wings in the locked position of the lock lever, wherein further preferably the second surface of the lock lever is contact-free from the contact surface of the wings in the open position of the lock lever. Such an embodiment allows to lock the lighting cap to the lock lever very easily and further the lock lever can be fixed in the locked position also to the holder, inhibiting any movement of the lighting cap relative to the holder, in particular in the direction of illumination. Additionally, also the contact surface of the wings act in an advantageous manner as an axial mating reference plane to align the lighting cap and the holder. The contact surface of the wings may be a surface of each wing, which is parallel to the front face and/or to the support plane surface and which is directed towards the support plane surface and/or facing away from the direction of illumination. By rotating the lock lever from the open position into the locked position, a part of the lock lever, in particular an area adjacent to the rim of the opening of the lock lever, is rotated under or in in-plane contact with the contact surface of the wings, locking the lighting cap from being unplugged from the holder.

At least one spring element may be provided on a support plane surface of the lighting cap, wherein the support plane surface is parallel to the front face and recessed in the direction of illumination relative to the front face. The spring element may be provided to press the lock lever against the contact surface of each of the wings in the locked position of the lock lever. The use of a spring element leads to a reliable transfer of the orientation of the lighting cap via the lock lever to the holder. As a spring element any element may be used, which reacts on a force with an opposite reacting force. Preferably, the reacting force of the spring element originates from an elasticity of the material of the spring element, in particular of a polymer material. Also preferably, the spring element is arranged between the support plane surface of the lighting cap and the first surface of the lock lever, acting on the first surface and thereby pressing the second surface of the lock lever at least partially against the contact surface of each of the wings. Additionally, the second surface of the lock lever is most preferably also partially in an in-plane support with the holder, aligning the lighting cap and the holder in the reference plane. The spring element may be fixed to a surface of the lighting cap, in particular to the support plane surface. The support plane surface of the lighting cap may be a flat surface or alternatively may be formed by a number of supporting points or areas. Preferably, the support plane surface is at least a flat area extending over the full circumference, in particular around the front face, on the lighting cap.

In a preferred embodiment, the spring element is an elastic seal arranged on the support plane surface of the lighting cap. Preferably, the elastic seal is a ring encompassing the front face on the support plane surface of the lighting cap advantageously applying force evenly over the whole circumference on the first surface of the lock lever in a locked position.

BRIEF DESCRIPTION OF THE DRAWINGS

The above and other features and advantages of the present invention will become apparent from and elucidated with reference to the following description of preferred embodiments, in which.

DETAILED DESCRIPTION OF EMBODIMENTS

Figure 1:
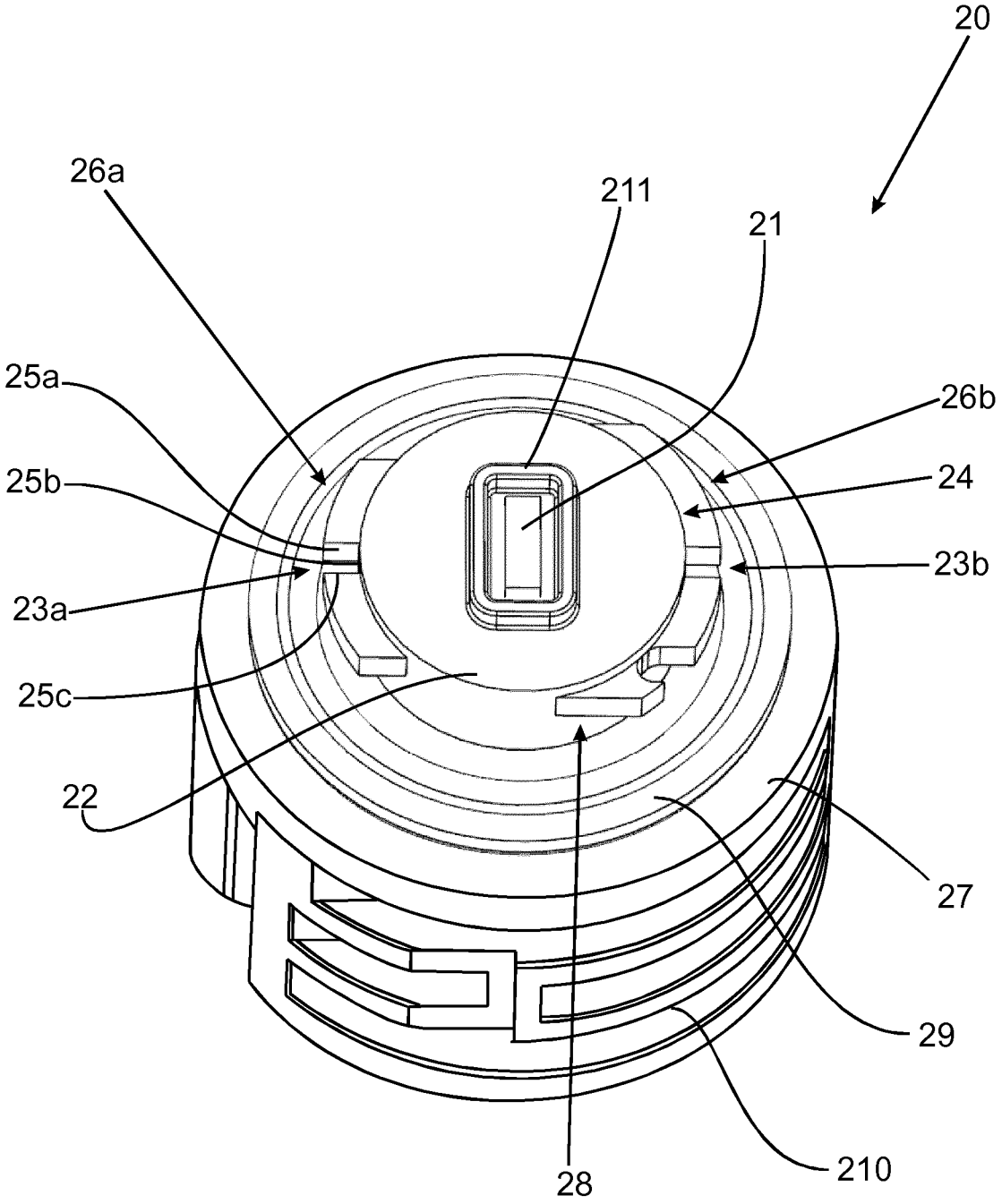
FIG. 1 shows a perspective view of an embodiment of a lighting cap.

FIG. 1 shows a perspective view of a lighting cap 20. In the center of a front face 22 of the lighting cap 20 a light emitting diode with a plane light emitting surface as a light emitting element 21 is arranged. The light emitting element 21 is surrounded by a frame 211 protruding from the front face 22 by the height of the light emitting element 21. The light emitted from the light emitting element 21 is primarily directed in a direction perpendicular to a plane of the flat front face 22 of the lighting cap 20.

As shown in FIG. 1, the front face 22 has a circular shape. At an edge 24 of the front face 22 two wings 26*a, b* extend in a plane parallel to the front face 22, wherein both wings 26*a, b* are placed on opposing sides of the light emitting element 21. The plane of the wings 26*a, b* is arranged slightly offset to the front face 22. Each of the wings 26*a, b* has a different width along the circumference of the edge 24 of the front face 22, allowing to insert the lighting cap 20 only in one orientation into a holder 30, as it becomes apparent from FIG. 2*c*. The height of both wings 26*a, b* along the direction of illumination and the length of both wings 26*a, b* in a direction perpendicular to the direction of illumination is identical in this embodiment.

Each of the wings 26*a, b* is divided into two equal parts by a positioning slot 23*a, b*, which is formed as a gap in each wing 26*a, b* reaching the edge 24 of the front face 22. Both positioning slots 23*a, b* have a cubic shape and extend through the full height of each wing 26*a, b* along the direction of illumination. Accordingly, each of the positioning slots 23*a, b* has three inner faces 25*a, b, c*. At least the wings 26*a, b*, preferably also the front face 22 are made out of a polymer material, which has elastic properties and which in particular can be compressed by 2-5% when a positioning element 33*a, b* of a holder 30 is pressed into the positioning slot 23*a, b* of the lighting cap 20.

In a position set back relative to the front face 22 and the wings 26*a, b*, the lighting cap 20 comprises a cooling body 210 made of a thermally conductive polymer material. The part of the lighting cap 20 comprising the front face 22 and the light emitting element 21 is arranged in the center of a planar surface of the cooling body 210. This planar surface has also a circular shape with a larger diameter than the diameter of the front face 22 and functions as a support plane surface 27 to help to align the lighting cap 20 relative to other parts of a lighting arrangement 10, in particular to a lock lever 40.

Figure 2A:
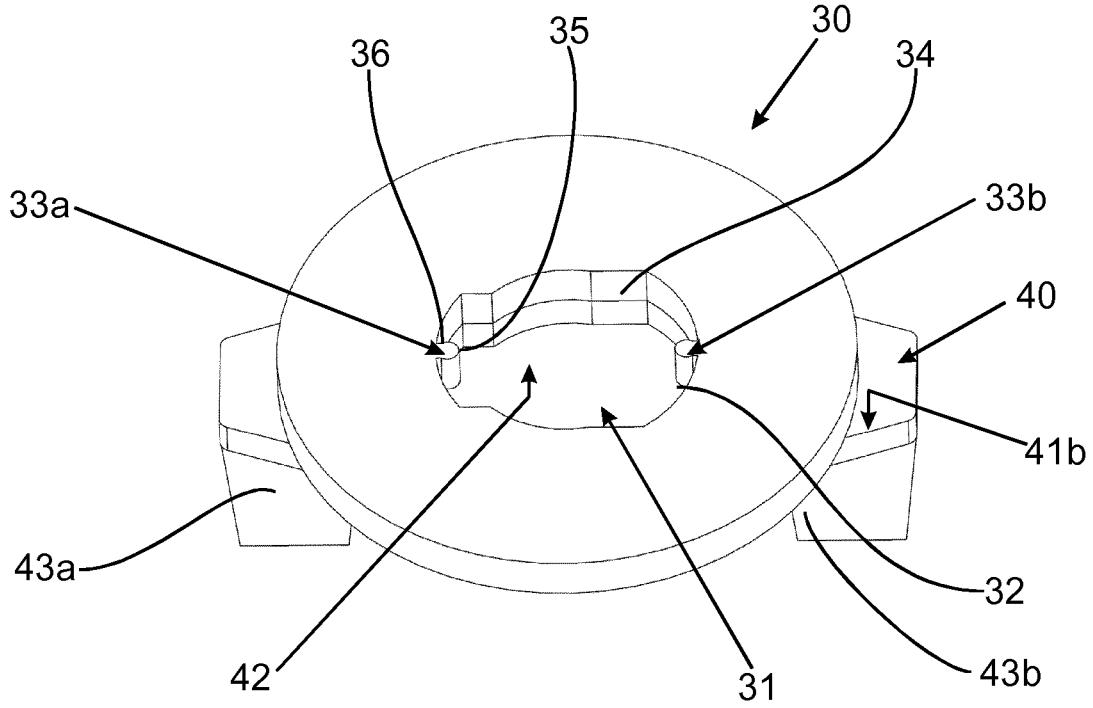
FIG. 2*a* shows a perspective view of a holder and a lock lever of an embodiment of a lighting arrangement.

FIG. 2*a* shows a holder 30 and a lock lever 40 of the lighting arrangement 10. The holder 30 has an opening 31, wherein the shape of the opening 31 corresponds to the shape of the front face 22 and the wings 26*a, b* of the lighting cap 20. Two positioning elements 33*a, b* are arranged at the rim 32 of the opening 31 extending towards the center of the opening 31. Both positioning elements 33*a, b* are positioned at opposing sides of the rim 32, wherein the exact position of the positioning elements 33*a, b* corresponds to the arrangement of the positioning slots 23*a, b* on the lighting cap 20.

Each of the positioning elements 33*a, b* comprises a rounded head 35, which is connected via a connection section 36 to the rim 32 of the opening 31 and in particular to the inner peripheral surface 34 of the opening 31. The rounded head 35 is rounded in both spatial directions perpendicular to the direction of illumination and flat in the direction of illumination. At least both rounded heads 35, preferably both positioning elements 33*a, b* and most preferably the holder 30 is made of an elastic polymer material. Accordingly, also the both positioning elements 33*a, b* can be compressed during inserting into the positioning slots 23*a, b*, leading to a well-defined press-fit of both components.

The lock lever 40 comprises also an opening 42, wherein the shape of the opening 42 of the lock lever 40 corresponds to the shape of the opening 31 of the holder 30. As shown in FIG. 2*a*, in an open position of the lock lever 40, both openings 31, 42 are superposed, such that the lighting cap 20 can be inserted into the openings 31, 42. To insert the lighting cap 20, both the lock lever 40 and the holder 30 are arranged in a flat contact to each other. For turning the lock lever 40 by hand, two handles 43*a, b* are arranged on the lock lever 40 on two opposing sides of the opening 42.

Figure 2B:
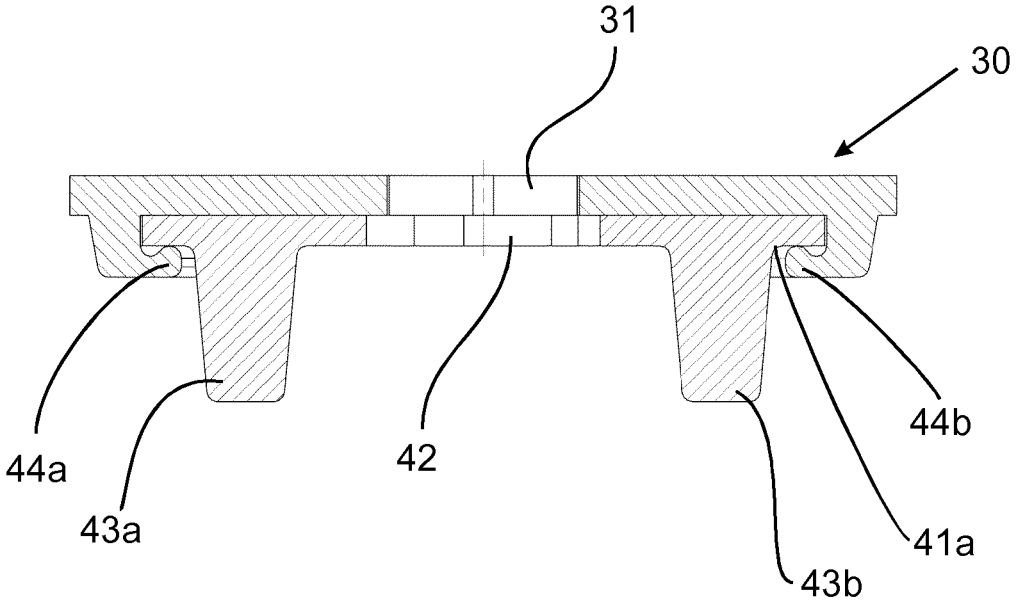
FIG. 2*b* shows a sectional side view of an alternative embodiment of a holder and a lock lever.
Figure 2C:
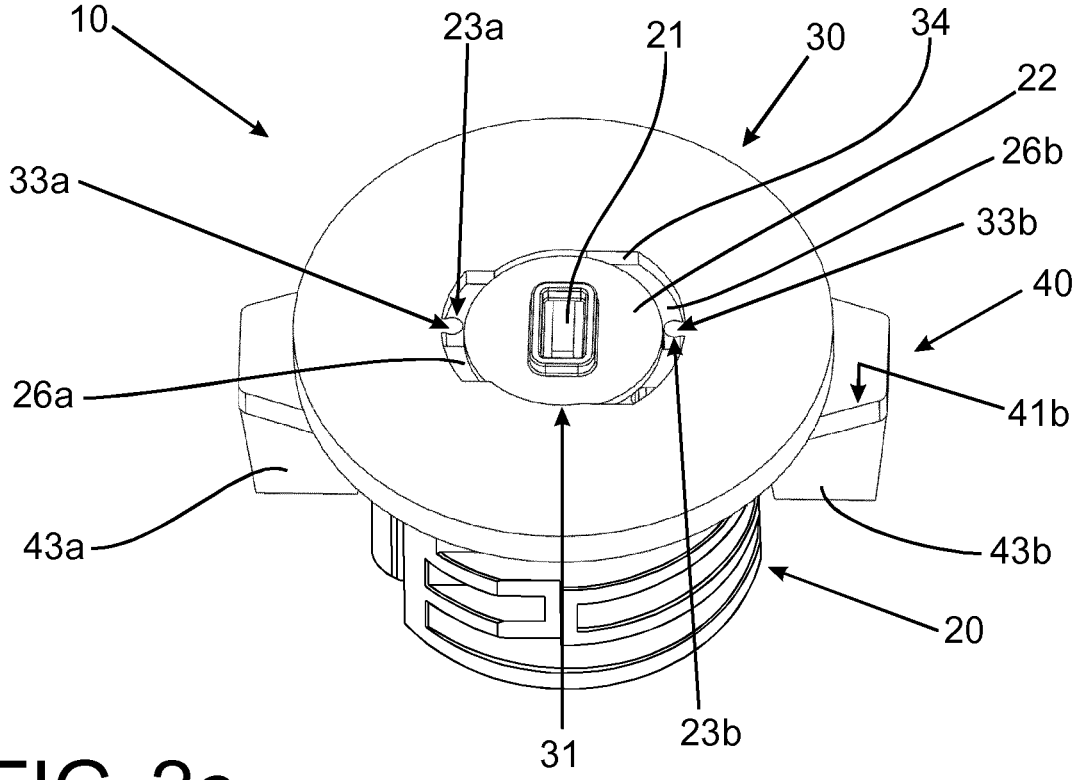
FIG. 2*c* shows a perspective view of a lighting arrangement with the lock lever of FIG. 2*a* in an open position.

When the lighting cap 20 is arranged in the opening 31 of the holder 30, the rim of the front face 22 as well as of the wings 26*a, b* is not in contact with, but arranged close to the inner peripheral surface 34 of the opening 31 of the holder 30, as shown in FIG. 2*c*. However, both positioning elements 33*a, b* have been inserted into the corresponding positioning slot 23*a, b* of the lighting cap 20 under elastic compression to achieve a press-fit, wherein in particular the rounded heads 35 are deformed and a section of the surface of the rounded head 35 is in a flat contact to each of the three inner faces 25*a, b, c* of each positioning slot 23*a, b* due to the compression of the material.

Figure 3A:
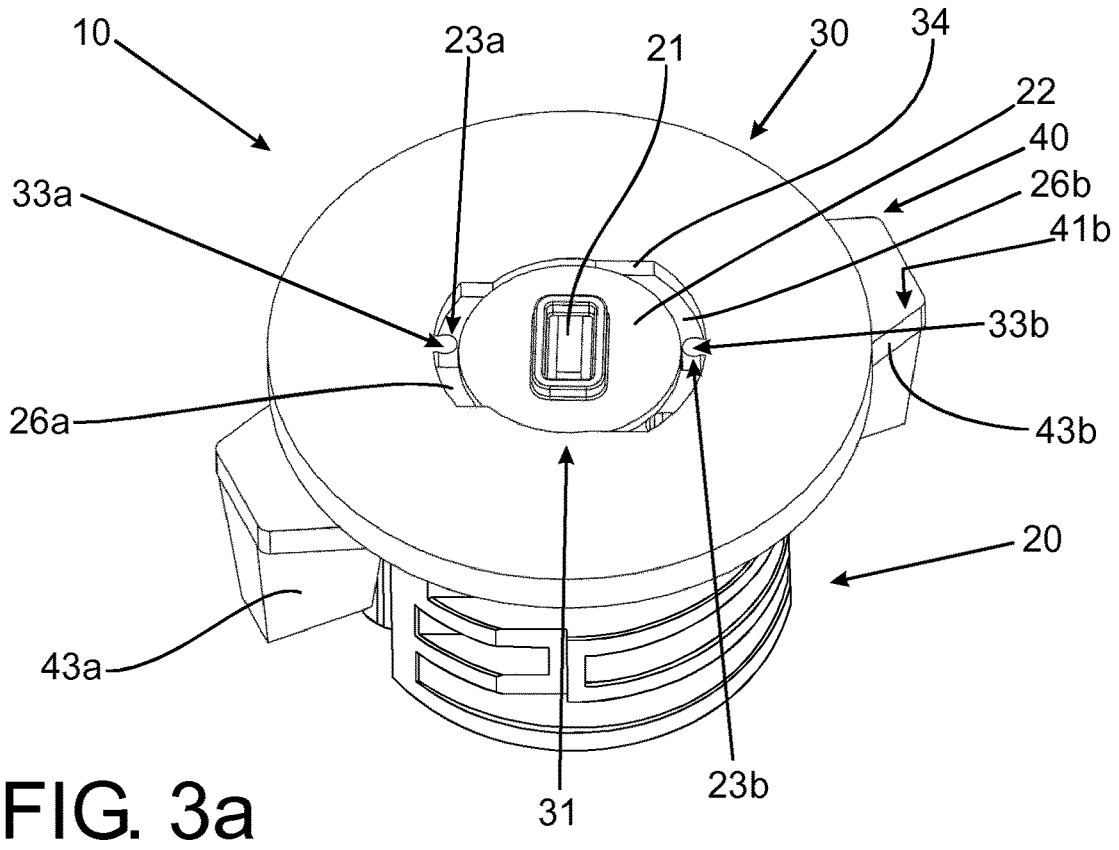
FIG. 3*a* shows a perspective view of the lighting arrangement of FIG. 2*c* with the lock lever in a locked position.

After the lighting cap 20 is positioned inside the opening 31 of the holder 30, the lock lever 40 is turned by 45° from an open position, as shown in FIG. 2*c*, into a locked position, as shown in FIG. 3*a*. The opening 42 of the lock lever 40, which is superposed with the opening 31 of the holder 30 in the open position of the lock lever 40, is turned relative to the opening 31 of the holder 30 in the locked position, locking the lighting cap 20 against being pulled out of the holder 30.

On the surface of an embodiment of the holder 30 facing the lock lever 40, two spring holder 44*a, b* are arranged to engage with the first surface 41*a* of the lock lever 40 in the locked position, as shown in FIG. 2*b*. In an embodyment comprising to spring holders 44*a, b*, it is preferred that the holder 30 has a larger diameter than the lock lever 40, in particular larger than the distance between the outmost positions of the handles 43 of the lock lever 40. The spring holders 44*a, b* each apply a force on the first surface 41*a* of the lock lever 40, pressing the lock lever 40 towards and against the reference plane RP on the holder 30.

Figure 3B:
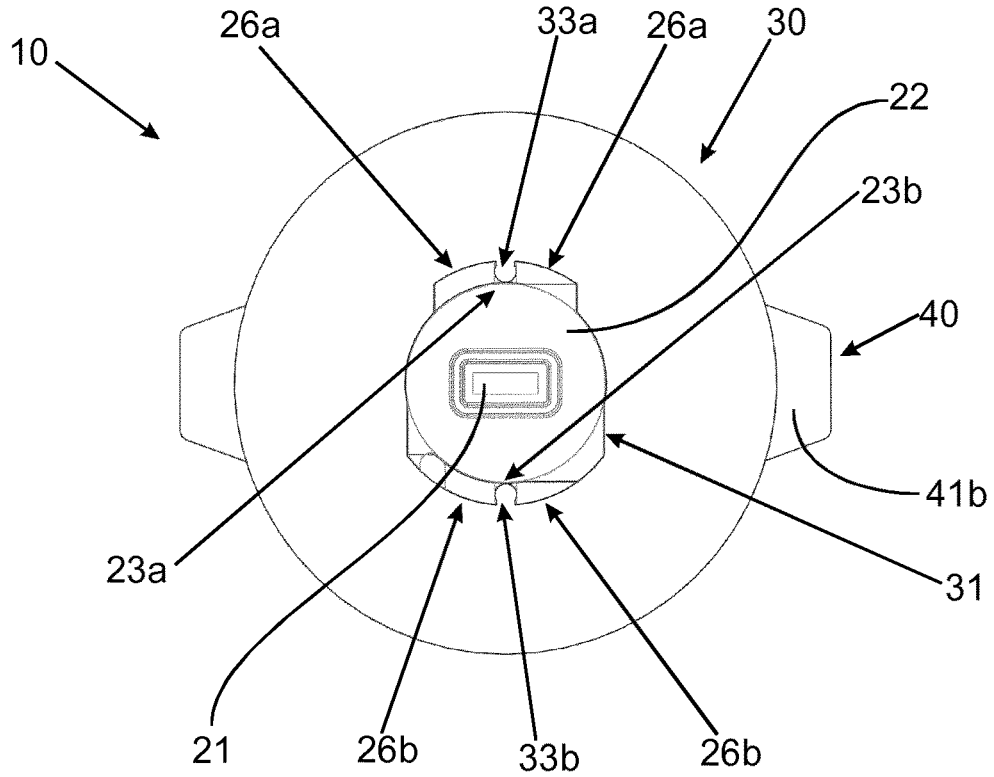
FIG. 3*b* shows a top view of the lighting arrangement of FIG. 3*a;*

In FIG. 3*b* the lighting cap 20 is depicted transparently. The opening 42 of the lock lever 40 is turned relative to the opening 31 of the holder 30 and accordingly, parts of the surface 41*b* of the lock lever 40 are now in contact with a contact surface 28 on the side of the wings 26*a, b* facing away from the front face 22, which leads to a bayonet-locking of the lighting cap 20.

Figure 4:
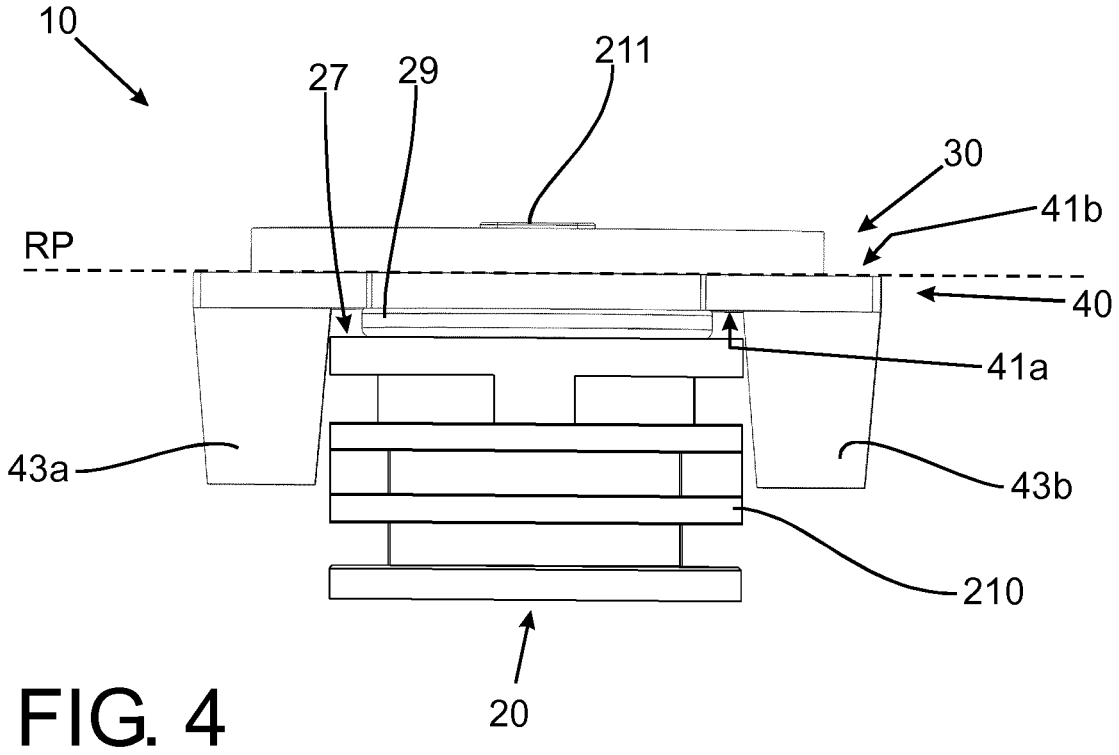
FIG. 4 shows a side view of the lighting arrangement of FIG. 3*a;*
Figure 5:
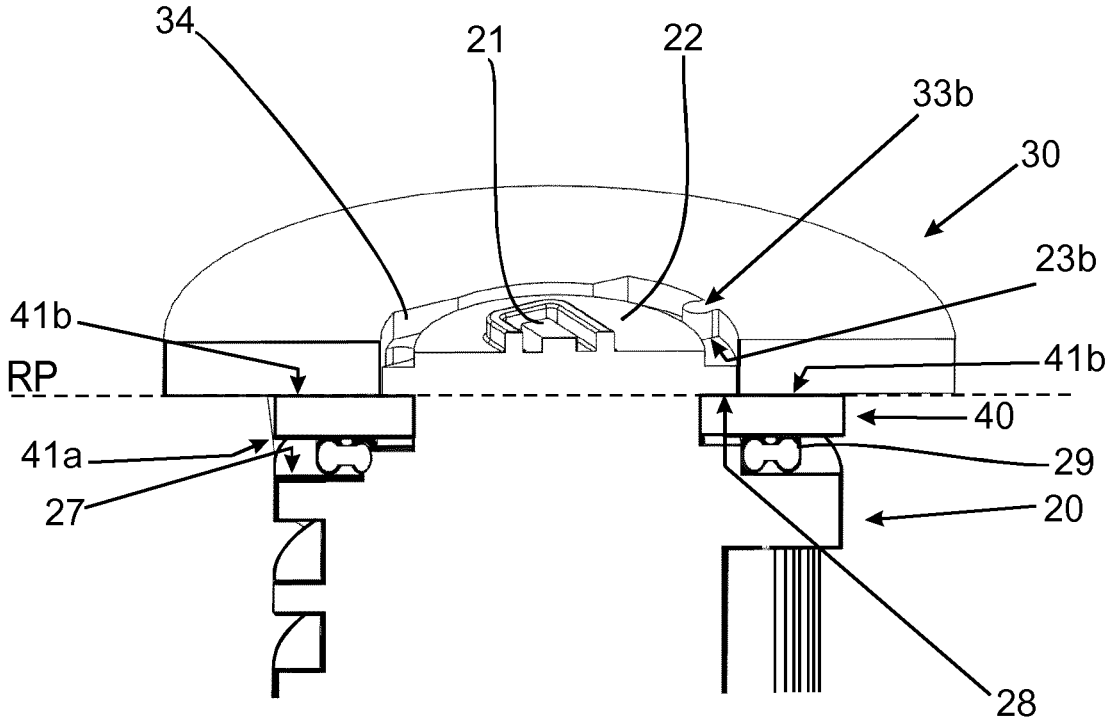
FIG. 5 shows a sectional view of the lighting arrangement of FIG. 3*a.*

To press the lock lever 40, in particular the upper surface 41*b* of the lock lever 40, against the contact surface 28 of the wings 26*a, b* in a reference plane RP, as a spring element 29 an elastic ring is placed on and fixed to the support plane surface 27 of the lighting cap 20 surrounding the front face 22. By the force applied by the spring element 29 onto the lower surface 41*a* of the lock lever 40, the upper surface 41*b* of the lock lever 40 is pressed against the contact surface 28 of each of the wings 26*a, b* of the lighting cap 20, ensuring that there is an in-plane contact between both surfaces 41*b*, 28, as shown in FIG. 5. Since the contact surface 28 and the front face 22 are aligned perfectly parallel to one another, also both surfaces 41*a, b*, which are also parallel to one another, are parallel to the front face 22 of the lighting cap 20. Accordingly, when the upper surface 41*b* of the lock lever 40 is in an in-plane contact with a surface of the holder 30 in the reference plane RP, the front face 22 of the lighting cap 20 is perfectly aligned with the holder 30 via the lock lever 40, as shown in FIG. 4. Correspondingly, no further reference surface surrounding the light emitting element 21 at the lighting cap 20 is necessary.

While the invention has been illustrated and described in detail in the drawings and foregoing description, such illustration and description are to be considered illustrative or exemplary and not restrictive; the invention is not limited to the disclosed embodiments.

For example, only either the material of the wings 26*a, b* adjacent to the positioning slots 23*a, b* or alternatively the material of the positioning elements 33*a, b* may be elastic, also allowing a press-fitting of the positioning elements 33*a, b* inside the positioning slots 23*a, b*. The other of the two elements 26*a, b* or 23*a, b* may not provide a significant or intended contribution to the press-fitting. Alternatively, only one of the elastic inner faces 25*a, b, c* of the the positioning slots 23*a, b* may be elastic or may provide elastic deformation during insertion of a lighting cap 20, wherein the other two of the inner faces 25*a, b, c* might not be designed to contribute to the press-fitting of the lighting cap 20 in the holder 20 by elastic deformation.

Other variations to the disclosed embodiments can be understood and effected by those skilled in the art in practicing the claimed invention, from a study of the drawings the disclosure, and the appended claims.

In the claims, the word "comprising" does not exclude other elements or steps, and the indefinite article "a" or "an" does not exclude a plurality. The mere fact that certain measures are recited in mutual different dependent claims does not indicate that a combination of these measures cannot be used to advantage. Any reference signs in the claims should not be construed as limiting the scope.

The invention claimed is:

1. A lighting arrangement with an exchangeable lighting cap, comprising:

the lighting cap with at least one light emitting element arranged on a front face of said lighting cap, wherein a direction of illumination is perpendicular to the front face, and with two positioning slots arranged at an edge of the front face, each of the positioning slots being aligned perpendicular to the direction of illumination;

a holder with an opening for receiving at least the front face of the lighting cap, wherein two positioning elements are arranged at a rim of the opening, the positioning elements being insertable into the positioning slots of the lighting cap by elastic deformation of the holder or of the lighting cap to fix the position of the lighting cap in the holder by a tight fitting; and a lock lever arranged at the lighting cap and the holder, the lock lever being turnable between an open position for inserting the lighting cap into the opening of the holder and a locked position for locking the lighting cap in position on the holder.

2. The lighting arrangement according to claim 1, wherein the positioning elements are rounded pins and the positioning slots have a rectangular shape with three inner faces, wherein the rounded pins in an inserted position inside the positioning slots are elastically deformed and are in contact with each of the three inner faces.

3. The lighting arrangement according to claim 1, wherein the positioning slots are arranged on opposing sides of the light emitting element.

4. The lighting arrangement according to claim 1, wherein the lighting cap comprises a first and a second wing at the edge of the front face aligned perpendicular to the direction of illumination and each of the positioning slots is positioned in one of the wings.

5. The lighting arrangement according to claim 4, wherein the first wing has a different width along the circumference of the front face than the second wing.

6. The lighting arrangement according to claim 4, wherein the both wings are arranged on the lighting cap in a plane parallel to the front face.

7. The lighting arrangement according to claim 1, wherein the shape of the opening of the holder and the shape of the front face including the wings of the lighting cap correspond to each other.

8. The lighting arrangement according to claim 1, wherein the lock lever has two parallel surfaces, one of the surfaces being in an in-plane support with the holder in a reference plane between at least the holder and the lock lever.

9. The lighting arrangement according to claim 1, wherein the lock lever has two parallel surfaces and one of the surfaces of the lock lever is partially in an in-plane support with a contact surface of each of the wings in the locked position of the lock lever in a reference plane between at least the lighting cap and the lock lever.

10. The lighting arrangement according to claim 1, wherein the lighting cap comprises a support plane surface positioned parallel to the front face and shifted backwards relative to the front face and a spring element is provided on the support plane surface to press the lock lever against the contact surface of each of the wings in the locked position of the lock lever.

11. The lighting arrangement according to claim 10, wherein the spring element is an elastic seal arranged on the support plane surface of the lighting cap.

12. The lighting arrangement according to claim 1, wherein the lock lever is provided for bayonet-locking the lighting cap to the holder and two spring holders are arranged on a surface of the holder to engage with the first surface of the lock lever in the locked position pressing the lock lever towards the holder.

13. A method for turn-locking a lighting cap in a lighting arrangement, the method comprising:

providing a holder comprising an opening for the lighting cap with two positioning elements being arranged at a rim of the opening;

turning a lock lever with an opening into an open position where the opening of the lock lever and an opening of the holder are superposed;

inserting the lighting cap into the openings of the lock lever and the holder; and turning the lock lever into a locked position locking the lighting cap to the holder, wherein during inserting the lighting cap into the opening of the holder, each of the two positioning elements of the holder are pushed into a positioning slot of the lighting cap under elastic deformation of the holder or of the lighting cap to fix the position of the lighting cap in the holder by a tight fitting.

* * * * *